US009972927B2

(12) United States Patent
Nichols et al.

(10) Patent No.: US 9,972,927 B2
(45) Date of Patent: May 15, 2018

(54) ELECTRICAL POWER CONTACT WITH CIRCUIT PROTECTION

(71) Applicant: TYCO ELECTRONICS CORPORATION, Berwyn, PA (US)

(72) Inventors: Robert Paul Nichols, Vacaville, CA (US); Kevin Edward Weidner, Hummelstown, PA (US); David Patrick Orris, Middletown, PA (US); Julia Lachman, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 160 days.

(21) Appl. No.: 14/832,481

(22) Filed: Aug. 21, 2015

(65) Prior Publication Data

US 2017/0054243 A1 Feb. 23, 2017

(51) Int. Cl.

| | |
|---|---|
| ***H01R 13/71*** | (2006.01) |
| ***H01R 12/70*** | (2011.01) |
| ***H01R 13/713*** | (2006.01) |
| *H01C 7/02* | (2006.01) |
| *H01R 13/11* | (2006.01) |

(52) U.S. Cl.

CPC ..... *H01R 12/7088* (2013.01); *H01R 13/71* (2013.01); *H01R 13/7137* (2013.01); *H01C 7/021* (2013.01); *H01R 13/113* (2013.01)

(58) Field of Classification Search

CPC ..... H01R 13/68; H01C 7/02; H01C 7/021; H01C 7/13; H01C 1/1406; H01C 7/126; H02H 9/026; H05K 1/0201; H05K 1/167

USPC ..... 361/93.1, 103, 106, 115, 93.8; 439/88, 439/161, 181, 474, 620.08

See application file for complete search history.

(56) References Cited

U.S. PATENT DOCUMENTS

| | | | | |
|---|---|---|---|---|
| 6,147,850 | A * | 11/2000 | Gronowicz, Jr. | H01C 7/021 361/103 |
| 6,947,271 | B1 * | 9/2005 | Gronowicz, Jr. | H01C 7/02 361/93.1 |
| 7,138,900 | B2 * | 11/2006 | Liu | H01C 1/142 338/22 R |
| 7,341,679 | B2 * | 3/2008 | Handa | H01C 17/065 219/505 |
| 7,532,101 | B2 * | 5/2009 | Suzuki | H01C 1/1406 337/161 |
| 7,581,972 | B2 * | 9/2009 | Daamen | H01R 13/6315 439/249 |
| 8,058,966 | B2 * | 11/2011 | Koyama | H01C 1/1406 219/553 |

(Continued)

*Primary Examiner* — Michael A Lyons
*Assistant Examiner* — Matthew T Dzierzynski

(57) ABSTRACT

An electrical power contact includes a mating segment having a mating interface at which the electrical power contact is configured to mate with a mating contact. The mating segment includes an electrically conductive base layer, and an electrically conductive outer layer that includes the mating interface. The mating segment also includes a circuit protection layer that extends between the base layer and the outer layer. The circuit protection layer provides an electrical pathway between the base layer and the outer layer. The circuit protection layer includes a selectively conductive material that is configured to open the electrical pathway between the base layer and the outer layer when an electrical current above a predetermined threshold is passed through the circuit protection layer.

20 Claims, 5 Drawing Sheets

(56) References Cited

U.S. PATENT DOCUMENTS

| | | | | |
|---|---|---|---|---|
| 8,388,389 | B2 * | 3/2013 | Costello | H01R 13/18<br>439/637 |
| 2006/0157891 | A1 * | 7/2006 | Hardy | H01C 17/28<br>264/261 |
| 2009/0206980 | A1 * | 8/2009 | Yamashita | H01C 7/008<br>338/22 R |
| 2010/0194522 | A1 * | 8/2010 | Janning | H01C 7/13<br>338/22 R |
| 2015/0280340 | A1 * | 10/2015 | Anderson | H01R 13/03<br>439/524 |

* cited by examiner

ELECTRICAL POWER CONTACT WITH CIRCUIT PROTECTION

BACKGROUND OF THE INVENTION

The subject matter described and/or illustrated herein relates generally to power supplies for supplying electrical power to electrical systems.

Power supplies that supply electrical power to electronic systems are being designed to have greater power capacity (e.g., supply more electrical wattage) to accommodate the increased electrical power consumption of contemporary electronic systems. For example, power bus bars have been used with interconnect devices (e.g., electrical connectors and/or the like) that interconnect the power supply to the associated electronic system to handle the larger current load supplied by the power supply. But, at least some known interconnect devices for power supplies may be susceptible to overcurrent situations, which may damage and/or cause one or more components of the electronic system to fail. For example, an overcurrent situation may burn up a line card that is being supplied with electrical power by a known interconnect device that does not have the capability to break the circuit between the power supply and the line card when the overcurrent situation occurs. Specifically, a sufficient amount of current may be delivered to the line card to heat the line card to failure (e.g., by fracturing) from the mechanical stresses resulting from the increased temperature and/or the resulting thermal contraction of subsequent cooling.

BRIEF DESCRIPTION OF THE INVENTION

In an embodiment, an electrical power contact includes a mating segment having a mating interface at which the electrical power contact is configured to mate with a mating contact. The mating segment includes an electrically conductive base layer, and an electrically conductive outer layer that includes the mating interface. The mating segment also includes a circuit protection layer that extends between the base layer and the outer layer. The circuit protection layer provides an electrical pathway between the base layer and the outer layer. The circuit protection layer includes a selectively conductive material that is configured to open the electrical pathway between the base layer and the outer layer when an electrical current above a predetermined threshold is passed through the circuit protection layer.

In an embodiment, an electrical power contact includes a mating segment having a mating interface at which the electrical power contact is configured to mate with a mating contact. The mating segment includes an electrically conductive base layer, and an electrically conductive outer layer that includes the mating interface. The mating segment also includes a polymeric positive temperature coefficient (PPTC) layer that extends between the base layer and the outer layer. The PPTC layer provides an electrical pathway between the base layer and the outer layer. The PPTC layer is configured to open the electrical pathway between the base layer and the outer layer when an electrical current above a predetermined threshold is passed through the PPTC layer.

In an embodiment, an electrical power connector includes an electrical power contact having a mating segment that includes a mating interface at which the electrical power contact is configured to mate with a mating contact. The mating segment includes an electrically conductive base layer, and an electrically conductive outer layer that includes the mating interface. The mating segment also includes a circuit protection layer that extends between the base layer and the outer layer. The circuit protection layer provides an electrical pathway between the base layer and the outer layer. The circuit protection layer includes a selectively conductive material that is configured to open the electrical pathway between the base layer and the outer layer when an electrical current above a predetermined threshold is passed through the circuit protection layer.

DETAILED DESCRIPTION OF THE INVENTION

Figure 1:
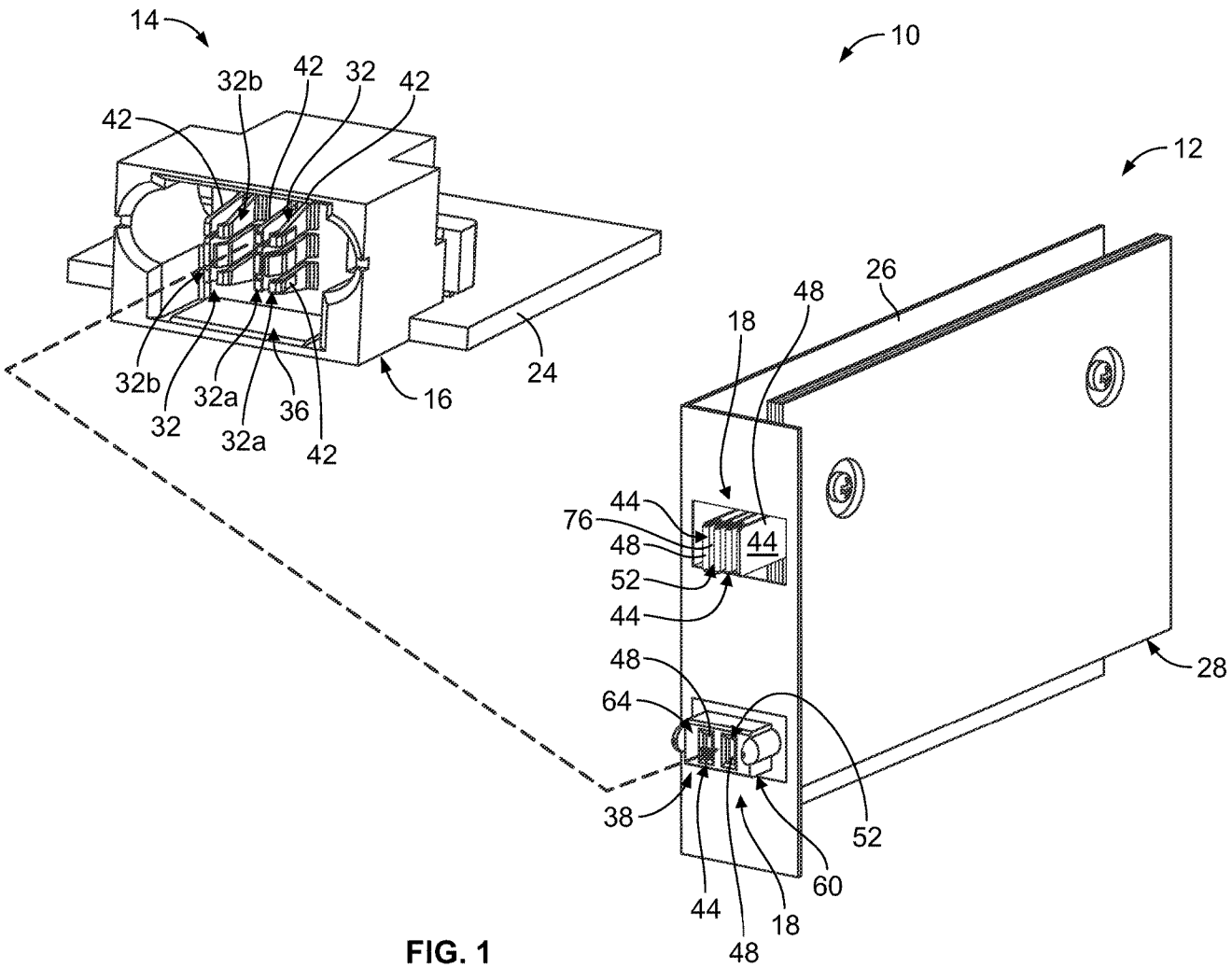
FIG. 1 is a perspective view of an embodiment of an assembly of an electronic system and an associated electrical power supply.

FIG. 1 is a perspective view of an embodiment of an assembly 10 of an electronic system 12 and an associated electrical power supply 14. The power supply 14 is configured to be mated with the electronic system 12 to supply the electronic system 12 with electrical power to drive operation of the electronic system 12. FIG. 1 illustrates the electronic system 12 and the power supply 14 in an unmated condition. The power supply 14 includes one or more electrical power connectors 16 that are configured to mate with a corresponding electrical power connector 18 of the electronic system 12 for supplying the electronic system 12 with electrical power. Optionally, the power supply 14 includes one or more signal connectors (not shown), and/or one or more of the power connectors 16 includes signal contact(s), for transmitting signals between the electronic system 12 and another component (not shown). Each power connector 16 and each power connector 18 may be referred to herein as a "mating connector".

The power supply 14 may be any type of electrical power supply having any components, structure, and/or the like. In the illustrated embodiment, the power supply 14 includes a printed circuit board 24. The power connector 16 of the power supply 14 is fixed in position on the circuit board 24 in the illustrated embodiment. But, in other embodiments, the power connector 16 floats relative to the printed circuit board 24. In addition or alternative to the printed circuit board 24, the power supply 14 may include one or more electrical wires (not shown) and/or other components (not shown). The power supply 14 may include any number of the power connectors 16 for mating with the electronic system 12. As shown herein, the power supply 14 includes a single power connector 16 and the electronic system 12 includes two power connectors 18. But, the electronic system 12 may include any number of power connectors 18 for mating with any number of power supplies 14.

In the illustrated embodiment, the electronic system 12 includes a backplane 26, a power bus bar assembly 28 mounted to the backplane 26, and one or more of the power connectors 18. The electronic system 12 also includes other components that are not shown herein for clarity. Such other components of the electronic system 12 that are not shown herein may include, but are not limited to, processing components, storage components, display components, and/or the like. The electronic system 12 may be any type of electronic system, such as, but not limited to, a line card, a motherboard, a processing unit, and/or the like. Optionally, the electronic system 12 includes one or more signal connectors (not shown), and/or one or more of the power connectors 18 includes signal contact(s), for transmitting signals between the electronic system 12 and another component (not shown). In some embodiments, the electronic system 12 includes one or more power connectors (not shown) that mate with one or more corresponding power connectors (not shown) of the power supply 14 to provide an electrical power input to the power supply 14 (i.e., supply electrical power to the power supply 14).

In the illustrated embodiment, the bus bar assembly 28 includes four layers that are stacked against each other, as can be seen in FIG. 1. Portions of the layers may be covered (e.g., coated) with an electrically insulating material to electrically isolate the layers from each other and/or to facilitate preventing electrical shorting and/or electrical shock. Although the illustrated embodiment of the bus bar assembly 28 includes four layers, the bus bar assembly 28 may include any number of layers. In some embodiments, the bus bar assembly 28 includes only a single layer. The bus bar assembly 28 may be referred to herein as a "power bus bar", regardless of the number of layers.

Figure 2:
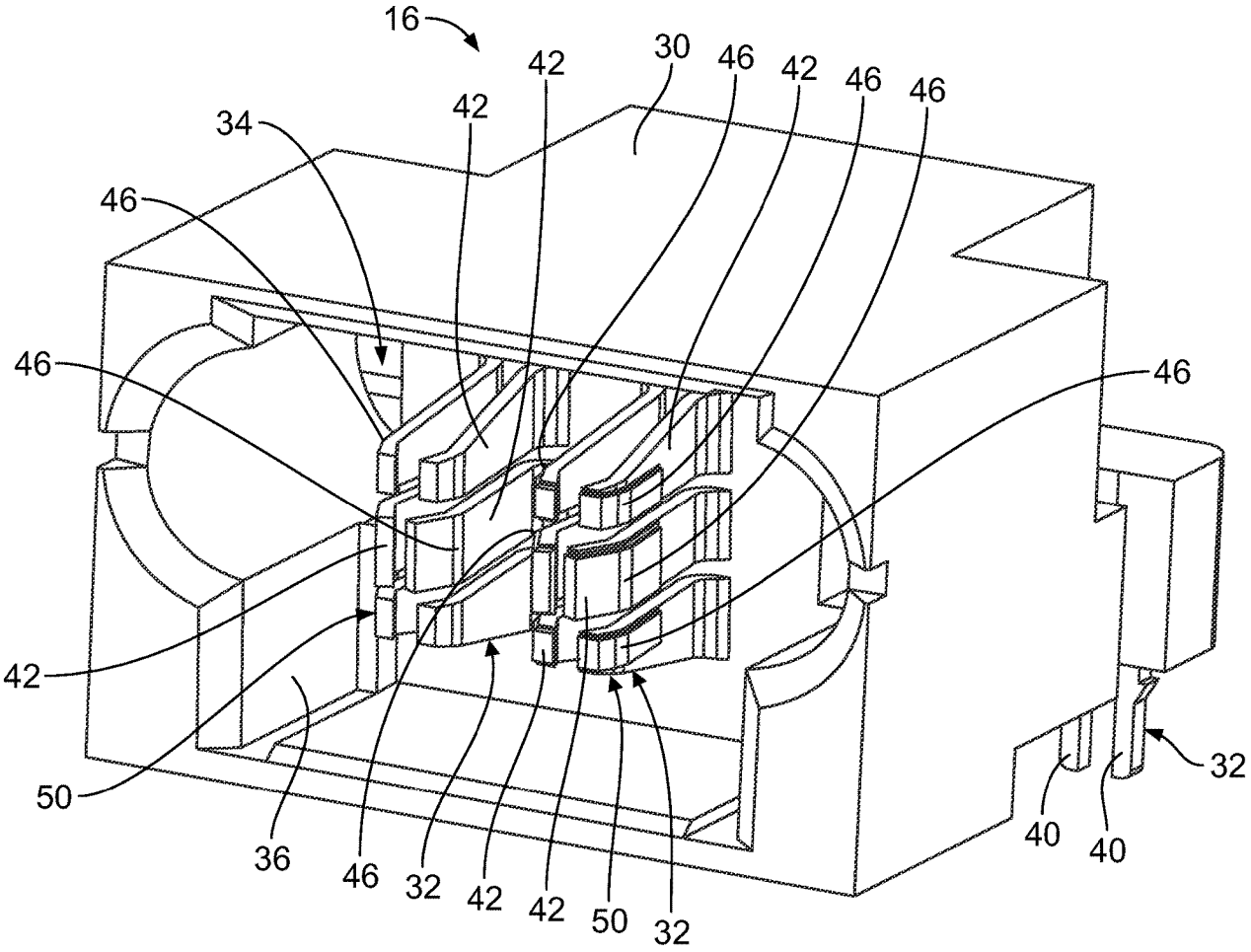
FIG. 2 is a perspective view of an embodiment of an electrical power connector of the power supply shown in FIG. 1.

FIG. 2 is a perspective view of an embodiment of the electrical power connector 16 of the power supply 14 (shown in FIG. 1). The power connector 16 includes a housing 30 and one or more electrical power contacts 32 held by the housing 30. The housing 30 includes a mating interface 34 at which the housing 30 mates with the corresponding power connector 18 (shown in FIGS. 1, 5, and 6) of the electronic system 12 (shown in FIG. 1). In the illustrated embodiment, the mating interface 34 includes a receptacle 36 that receives a plug 38 (shown in FIG. 1) of the corresponding power connector 18 therein such that the illustrated embodiment of the power connector 16 is a receptacle connector. But, the mating interface 34 of the power connector 16 may additionally or alternatively include any other structure (such as, but not limited to, a plug and/or the like) for mating with the corresponding power connector 18.

The power contacts 32 include mounting segments 40 for mounting the power connector 16 to the printed circuit board 24 (shown in FIG. 1) of the power supply 14. In the illustrated embodiment, the mounting segments 40 are solder tails, but the mounting segments 40 may additionally or alternatively have any other structure, such as, but not limited to, a surface mount structure, a compliant pin (e.g., an eye-of-the needle pin) structure, and/or the like. In addition or alternatively to being mounted to the printed circuit board 24, one or more of the mounting segments 40 of the power contacts 32 may terminate one or more electrical wires (not shown).

The power contacts 32 include mating segments 42 for mating with corresponding electrical power contacts 44 (shown in FIGS. 1, 5, and 6) of the corresponding power connector 18. The power contacts 32 are held by the housing 30 of the power connector 16 such that the mating segments 42 extend within the receptacle 36 of the housing 30. Each mating segment 42 includes a mating interface 46 at which the mating segment 42 mates (i.e., engages in physical contact and thereby electrical connection) with the corresponding power contact(s) 44 of the corresponding power connector 18. In the illustrated embodiment, each power contact 32 includes three mating segments 42. But, each power contact 32 may include any number of mating segments 42 for mating with any number of mating segments 48 of the corresponding power contact(s) 44. In some embodiments, one or more of the power contacts 32 includes only a single mating segment 42. Although shown as spring beams, each mating segment 42 additionally or alternatively may have any other structure, shape, geometry, and/or the like, including mating segments 42 that include two or more mating interfaces 46 (e.g., a fork arrangement and/or the like).

Although shown as including four power contacts 32, the power connector 16 may include any number of the power contacts 32. As can be seen in FIG. 2, in the illustrated embodiment, the power contacts 32 are arranged in pairs; however, the power contacts 32 may be arranged in any other pattern. Moreover, in the illustrated embodiment, the mating segments 42 of each pair of power contacts 32 define a plug 50 that is configured to be received within a receptacle 52 (shown in FIGS. 1, 5, and 6) defined by one or more corresponding power contacts 44 of the corresponding power connector 18. In other embodiments, the mating segments 42 of two or more power contacts 32 are arranged to define a receptacle (not shown) that receives a plug (not shown) defined by one or more corresponding power contacts 44. Other arrangements are possible in other embodiments, regardless of whether the power contacts 32 are arranged in pairs or larger groups.

Figure 3:
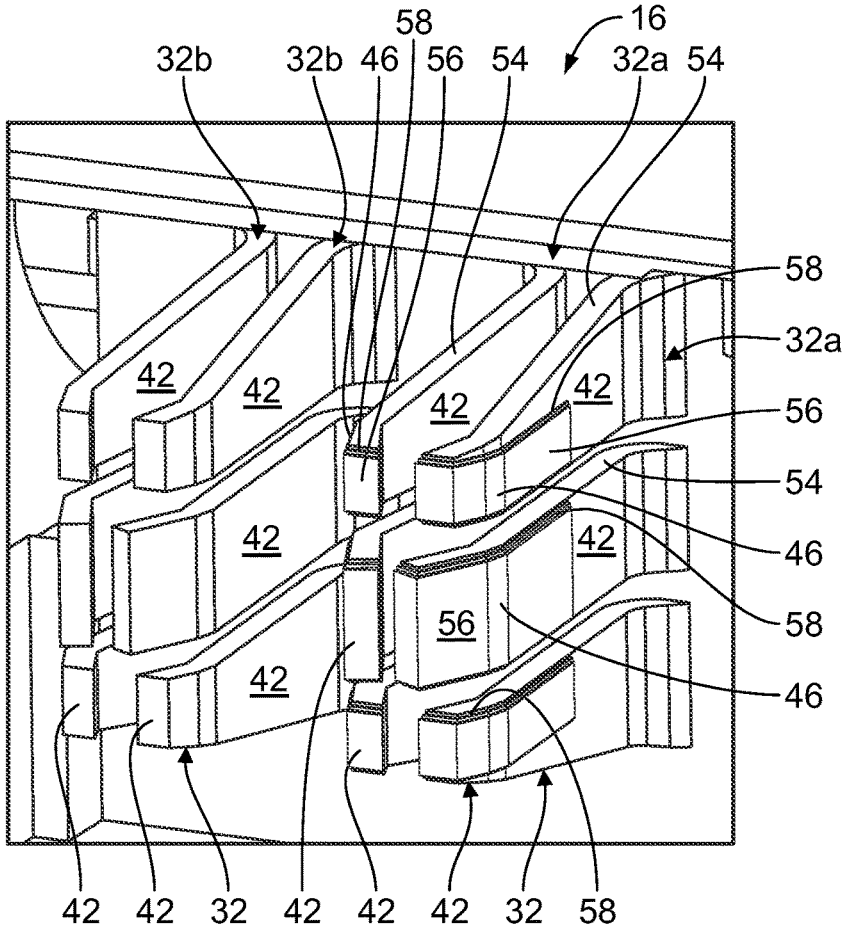
FIG. 3 is a perspective view of a portion of the electrical power connector shown in FIG. 2 illustrating an embodiment of electrical power contacts of the power connector.

FIG. 3 is a perspective view of a portion of the power connector 16 illustrating an embodiment of the mating segments 42 of the electrical power contacts 32. FIG. 3 illustrates two pairs of the power contacts 32, namely a pair of power contacts 32*a* and a pair of power contacts 32*b*. As will be described in more detail below, the mating segments 42 of the power contacts 32*a* include circuit protection elements that are configured to protect the power supply 14 (shown in FIG. 1) from overcurrent faults. Each of the power contacts 32*a* may be referred to herein as a "first" electrical power contact. Each of the power contacts 32*b* may be referred to herein as a "second" electrical power contact.

Figure 4:
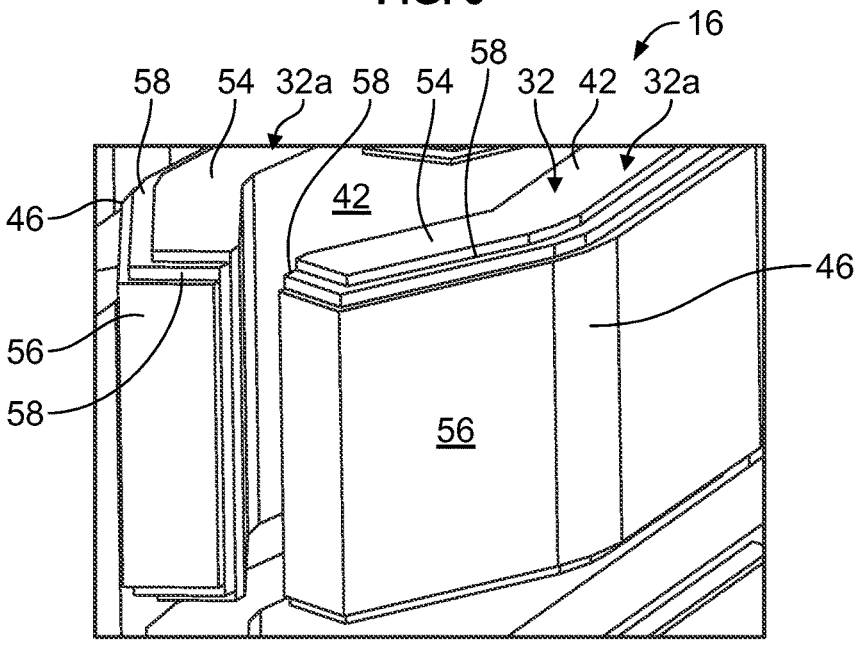
FIG. 4 is an enlarged perspective view of the electrical power contacts shown in FIG. 3 illustrating an embodiment of mating segments thereof.

FIG. 4 is an enlarged perspective view illustrating an embodiment of the mating segments 42 of the power contacts 32*a*. Referring now to FIGS. 3 and 4, the mating segments 42 of the power contacts 32*a* include an electrically conductive base layer 54 and an electrically conductive outer layer 56 that extends over the base layer 54. As shown in FIGS. 3 and 4, the outer layer 56 defines an outer surface (of the corresponding mating segment 42) that includes the mating interface 46 of the mating segment 42.

A circuit protection layer 58 extends between the base layer 54 and the outer layer 56. In other words, the circuit protection layer 58 is sandwiched between the outer layer 56 and the base layer 54. The circuit protection layer 58 provides an electrical pathway between the base layer 54 and the outer layer 56. Specifically, the circuit protection layer 58 includes a selectively conductive material (i.e., a material that can change between an electrically conductive state and an electrically non-conductive state) that is engaged in physical contact between the outer layer 56 and the base layer 54. When the selectively conductive material is in an electrically conductive state, the physical contact of the circuit protection layer 58 with the base layer 54 and the outer layer 56 enables the circuit protection layer 58 to pass electrical energy between the base layer 54 and the outer layer 56. The electrical pathway between the base layer 54 and the outer layer 56 provided by the circuit protection layer 58 is thus closed when the circuit protection layer 58 is in an electrically conductive state. When the circuit protection layer 58 is in an electrically non-conductive state, the electrical pathway between the base layer 54 and the outer layer 56 provided by the circuit protection layer 58 is open such that the base layer 54 and the outer layer 56 are not electrically connected together.

As briefly described above, the circuit protection elements (e.g., the circuit protection layer 58) of the power contacts 32*a* are configured to protect the power supply 14 from overcurrent faults. Specifically, the circuit protection layer 58 is configured to open the electrical pathway between the base layer 54 and the outer layer 56 when an electrical current above a predetermined threshold is passed through the circuit protection layer 58. In other words, when the electrical current passing through the circuit protection layer 58 exceeds the predetermined threshold, the selectively conductive material of the circuit protection layer 58 changes from an electrically conductive state to an electrically non-conductive state such that the base layer 54 and the outer layer 58 are no longer electrically connected together. The circuit protection layer 58 thus provides overcurrent protection by opening the electrical pathway between the base layer 54 and the outer layer 56 during an overcurrent fault.

In the illustrated embodiment, the selectively conductive material of the circuit protection layer 58 is selectively conductive based on the temperature of the selectively conductive material. In other words, the illustrated embodiment of the selectively conductive material of the circuit protection layer 58 is configured to open the electrical pathway between the base layer 54 and the outer layer 56 when the selectively conductive material is heated to a predetermined temperature threshold. In other embodiments, the circuit protection layer 58 additionally or alternatively may include one or more other types of selectively conductive materials.

The specific type of selectively conductive material of the circuit protection layer 58 that is used in the illustrated embodiment is a polymeric positive temperature coefficient (PPTC) material. A PPTC material is a non-conductive crystalline organic polymer matrix that is loaded with electrically conductive particles such that the material is electrically conductive. Examples of PPTC materials include, but are not limited to, a thermally conductive plastic loaded with carbon black particles, and/or the like. In other embodiments, the circuit protection layer 58 may include one or more other types of selectively conductive materials in addition or alternatively to a selectively conductive material that is selectively conductive based on temperature (such as, but not limited to, a positive temperature coefficient (PTC) material).

The operation of the circuit protection layer 58 will now be described. The PPTC material of the circuit protection layer 58 has a current rating. Specifically, when the circuit protection layer 58 is below a predetermined threshold temperature, the electrical pathway between the base layer 54 and the outer layer 56 provided by the circuit protection layer 58 is closed such that the circuit protection layer 58 is configured to pass a predetermined electrical current (referred to herein as the "hold current") between the base layer 54 and the outer layer 56 (referred to herein as the "on" state of the circuit protection layer 58). More specifically, when the circuit protection layer 58 is below the predetermined threshold temperature, the PPTC material is in a crystalline state, with the conductive particles forced into regions between crystals forming conductive chains. The PPTC material of the circuit protection layer 58 thus has a relatively small resistance (referred to herein as the "initial resistance") when the circuit protection layer 58 is below the predetermined threshold temperature such that the circuit protection layer 58 will pass the hold current). Accordingly, when the circuit protection layer 58 is in the on state, the corresponding power contact 32*a* can carry the hold current between the power supply 14 (shown in FIG. 1) and the corresponding power connector 18 (shown in FIGS. 1, 5, and 6).

When electrical current flowing through the corresponding power contact 32*a*, and thus the circuit protection layer 58, exceeds a predetermined current limit (referred to herein as the "trip current"), the circuit protection layer 58 is altered by heat. The polymer of the PPTC material of the circuit protection layer 58 expands as the circuit protection layer 58 is heated by the excess electrical current. Once the PPTC material of the circuit protection layer 58 is heated to the predetermined threshold temperature, the expansion of the PPTC material changes the PPTC material from a crystalline state into an amorphous state. Specifically, the expansion separates the conductive particles of the PPTC material and thereby breaks the conductive pathways of the circuit protection layer 58, which substantially increases (e.g., by two or more orders of magnitude) the resistance of the circuit protection layer 58.

The increased resistance of the circuit protection layer 58 reduces the amount of electrical current carried by the circuit protection layer 58 sufficiently to open the electrical pathway between the base layer 54 and the outer layer 56 (provided by the circuit protection layer 58) such that the circuit protection layer 58 is no longer capable of passing the hold current between the outer layer 56 and the base layer 54 (i.e., the "off" or "tripped" state of the circuit protection layer 58). Accordingly, the PPTC material of the circuit protection layer 58 is configured to open the electrical pathway between the outer layer 56 and the base layer 54 by physically expanding when heated by excess electrical current passing through the circuit protection layer 58.

As should be appreciated from the above description, the corresponding power contact 32*a* does not carry the hold current between the power supply 14 and the corresponding power connector 18 when the circuit protection layer 58 is in the off state. The circuit protection layer 58 is thus a passive circuit protection element that provides overcurrent protection for the corresponding power contact 32*a*, and thus for the power supply 14, the corresponding power connectors 16 and 18, and the electronic system 12 (shown in FIGS. 1, 5, and 6).

It should be understood that the circuit protection layer 58 will pass a relatively small amount of electrical current between the base layer 54 and the outer layer 56 when the circuit protection layer 58 is in the off state. The relatively small amount of electrical current carried by the circuit protection layer 58 in the off state may be sufficient to maintain the temperature of the circuit protection layer 58 at a level that is sufficient to maintain the increased resistance of the circuit protection layer 58 (i.e., the circuit protection layer 58 can be considered to have latching functionality).

When the excess electrical current (i.e., the overcurrent fault) is removed from the assembly 10 (shown in FIG. 1), the circuit protection layer 58 will cool. Once the circuit protection layer 58 has cooled to below the predetermined threshold temperature, the PPTC material of the circuit protection layer 58 will regain the original crystalline state and the circuit protection layer 58 will return to the initial resistance such that the circuit protection layer 58, and thus the corresponding power contact 32*a*, is capable of carrying the hold current. The circuit protection element 58 is thus resettable.

The circuit protection layer 58 may be configured to carry any value(s) of hold current. Moreover, the circuit protection layer 58 be configured with any value(s) of initial resistance. The predetermined threshold temperature selected for the circuit protection layer 58 may have any value(s).

The resistance of the circuit protection layer 58 may increase by any amount sufficient to change the circuit protection layer 58 from the on state to the off state, such as, but not limited to, by one or more orders of magnitude. Moreover, the circuit protection layer 58 may be configured with any value of trip current, such as, but not limited to, from approximately 20 mA to approximately 100 A. The increased resistance of the circuit protection layer 58 (described above) that reduces the amount of electrical current carried by the circuit protection layer 58 sufficiently to open the electrical pathway between the base layer 54 and the outer layer 56 may have any value(s), such as, but not limited to, hundreds of ohms, thousands of ohms, and/or the like.

Various parameters of the circuit protection layer 58 may be selected to provide the circuit protection layer 58 with predetermined physical and electrical properties. Examples of such parameters that may be selected for the circuit protection layer 58 include, but are not limited to, the type(s) of selectively conductive material, the type(s) of PPTC material, the amount of surface area of the base layer 54 of the mating segment 42 that is covered by the circuit protection layer 58, the location(s) along the mating segment 42 of the circuit protection layer 58, the size (e.g., the thickness, the surface area, and/or the like) of the circuit protection layer 58, the shape of the circuit protection layer 58, whether the outer layer 56 includes any perforations (described below), the number, shape, and/or size of perforations within the outer layer 56, and/or the like. Examples of such physical and electrical properties that may be selected for the circuit protection layer 58 include, but are not limited to, the electrical conductivity (e.g., in the on and/or the off state), the hold current, the initial resistance, the predetermined threshold temperature, the amount the resistance of the circuit protection layer 58 increases when the circuit protection layer 58 changes from the on state to the off state, the trip current, the resistance in the off state, the rate and/or amount of physical expansion as the circuit protection layer 58 rises in temperature, the thermal conductivity, a reset time, and/or the like. The circuit protection layer 58 may cover any amount, and have any location(s) along, the base layer 54 of the mating segment 42.

The outer layer 56 may be fabricated from any material(s) that provide the outer layer 56 as sufficiently electrically conductive to carry the hold current. In some embodiments, the outer layer 56 includes an abrasion resistant material. The outer layer 56 optionally is perforated (not shown), for example to accommodate and/or facilitate the temperature increase of the circuit protection layer 58 during an overcurrent fault, to accommodate the physical expansion of the circuit protection layer 58, and/or the like. The outer layer 56 may cover any amount, and have any location(s) along, each of the base layer 54 and the circuit protection layer 58 of the mating segment 42. In some embodiments, the circuit protection layer 58 covers more of the base layer 54 than the outer layer 56, the outer layer 56 covers more of the base layer 54 than the circuit protection layer 58, and/or the outer layer 56 does not cover the approximate entirety of the circuit protection layer 58.

Although two of the power contacts 32 (i.e., the power contacts 32*a*) are shown as including the circuit protection layer 58 and two of the power contacts 32 (i.e., the power contacts 32*b*) are shown as not including the circuit protection layer 58, any number of the power contacts 32 may include the circuit protection layer 58. Moreover, any number of the mating segments 42 of each power contact 32 may include the circuit protection layer 58.

Referring again to FIG. 1, the electronic system 12 is shown as including two of the power connectors 18 for connecting to two power supplies 14 (only one of which is shown); however, the electronic system 12 may include any number of the power connectors 18 for connecting to any number of the power supplies 12. One of the power connectors 18 is shown in FIG. 1 with the associated housing 60 (described below) removed to illustrate the electrical contacts 44 thereof. Each power connector 18 of the electronic system 12 includes the housing 60 (only one of which is shown in FIG. 1) and one or more of the electrical power contacts 44, which are held by the housing 60. Each of the power contacts 44 may be referred to herein as a "first" electrical power contact.

The housing 60 is mounted to the backplane 26 such that the housing 60 is indirectly mounted to the bus bar assembly 28, as is shown in FIG. 1. The housing 60 includes a mating interface 64 at which the housing 60 mates with the corresponding power connector 16 of the power supply 14. In the illustrated embodiment, the mating interface 64 includes the plug 38 that is received by the receptacle 36 of the corresponding power connector 16 such that the illustrated embodiment of the power connector 18 is a plug connector. But, the mating interface 64 of the power connector 18 may additionally or alternatively include any other structure (such as, but not limited to, a receptacle and/or the like) for mating with the corresponding power connector 16. In addition or alternatively to being mounted to the bus bar assembly 28 and/or the backplane 26, the housing 60 may be mounted to a printed circuit board (not shown) and/or may terminate one or more electrical wires (not shown).

In the illustrated embodiment, the power contacts 44 are defined by projections of the bus bar assembly 28 (i.e., the power contacts 44 are integral extensions of the bus bar assembly 28). In other embodiments, one or more of the power contacts 44 may be a discrete contact that is mounted to the bus bar assembly 28 (i.e., a component that is separate from the bus bar assembly 28 and is mounted thereto). Moreover, in addition or alternatively to being mounted to or defined by the bus bar assembly 28, one or more of the power contacts 44 may be mounted to a printed circuit board (not shown) and/or one or more of the power contacts 44 may terminate one or more electrical wires (not shown).

The power contacts 44 include the mating segments 48 for mating with the corresponding electrical power contacts 32 of the corresponding power connector 16. Each mating segment 48 includes a mating interface 76 (better seen in FIGS. 5 and 6) at which the mating segment 48 mates (i.e., engages in physical contact and thereby electrical connection) with the mating segment 42 of the corresponding power contact(s) 32 of the corresponding power connector 16. In the illustrated embodiment, each power contact 44 includes a single mating segment 48. But, each power contact 44 may include any number of mating segments 48 for mating with any number of mating segments 42 of the corresponding power contact(s) 32. Although shown as being generally rigid beams, each mating segment 48 additionally or alternatively may have any other structure, shape, geometry, and/or the like, including mating segments 48 that include two or more mating interfaces 76 (e.g., a fork arrangement and/or the like).

Although shown as including four power contacts 44, the power connector 18 may include any number of the power contacts 44. As can be seen in FIG. 1, in the illustrated embodiment, the power contacts 44 are arranged in pairs. But, the power contacts 44 may be arranged in any other pattern. Moreover, in the illustrated embodiment, the mating segments 48 of each pair of power contacts 44 define the receptacle 52 (better seen in FIGS. 5 and 6) that is configured to receive the plug 50 defined by one or more corresponding power contacts 32 of the corresponding power connector 16. In other embodiments, the mating segments 48 of two or more power contacts 44 are arranged to define a plug (not shown) that is configured to be received by a receptacle (not shown) defined by one or more corresponding power contacts 32. Other arrangements are possible in other embodiments, regardless of whether the power contacts 44 are arranged in pairs or larger groups.

Figure 5:
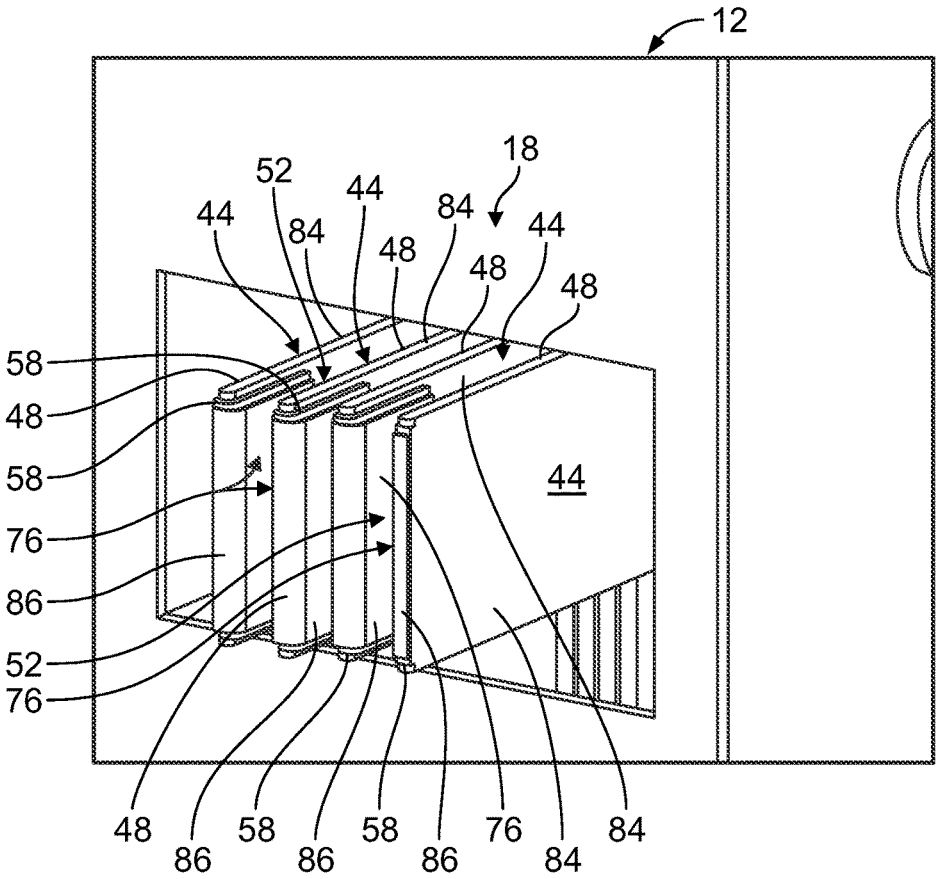
FIG. 5 is a perspective view of a portion of the electronic system shown in FIG. 1 illustrating an embodiment of an electrical power connector of the electronic system.
Figure 6:
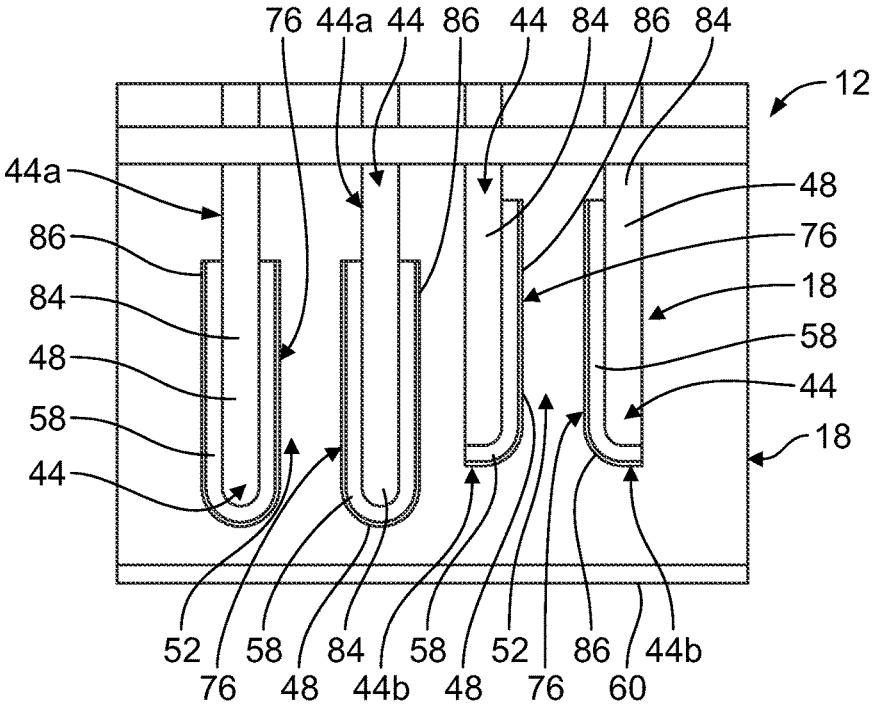
FIG. 6 is a top plan view of a portion of the electronic system shown in FIGS. 1 and 5 illustrating an embodiment of electrical power contacts of the power connector shown in FIG. 5.

FIG. 5 is a perspective view of a portion of the electronic system 12 illustrating an embodiment of the electrical power connector 18 of the electronic system 12. FIG. 6 is a top plan view of a portion of the electronic system 12 illustrating an embodiment of the electrical power contacts 44 of the power connector 18. Referring now to FIGS. 5 and 6, the housing 60 has been removed from the power connector 18 shown in FIG. 5 and one of the two power connectors 18 shown in FIG. 6 to better illustrate the power contacts 44. The mating segments 48 of the power contacts 44 include circuit protection elements that are configured to protect the electronic system 12 from overcurrent faults.

Specifically, the mating segments 48 include an electrically conductive base layer 84 and an electrically conductive outer layer 86 that extends over the base layer 84, with a circuit protection layer 58 extending between the base layer 84 and the outer layer 86. As shown in FIGS. 5 and 6, the outer layer 86 defines an outer surface (of the corresponding mating segment 48) that includes the mating interface 76 of the mating segment 48. The receptacles 52 described above are shown in FIGS. 5 and 6 as being defined between adjacent power contacts 44 of each pair.

As described above with respect to the power connectors 16 and the electronic system 12, the circuit protection layer 58 includes a selectively conductive material and is configured to protect against overcurrent faults. Specifically, the circuit protection layer 58 is configured to open an electrical pathway between the base layer 84 and the outer layer 86 (provided by the circuit protection layer 58) when an electrical current above the predetermined threshold is passed through the circuit protection layer 58 (i.e., during an overcurrent fault). When the circuit protection layer 58 is in the on state, the corresponding power contact 44 can carry the hold current between the electronic system 12 and the corresponding power connector 16 (shown in FIGS. 1-4). When the circuit protection layer 58 is in the off state, the corresponding power contact 44 does not carry the hold current between the electronic system 12 and the corresponding power connector 16. The circuit protection layer 58 is thus a passive circuit protection element that provides overcurrent protection for the corresponding power contact 44, and thus for the electronic system 12, the corresponding power connectors 18 and 16, and the power supply 14 (shown in FIG. 1). The circuit protection layer 58 may cover any amount, and have any location(s) along, the base layer 84 of the mating segment 48.

The outer layer 86 may be fabricated from any material(s) that provide the outer layer 86 as sufficiently electrically conductive to carry the hold current. In some embodiments, the outer layer 86 includes an abrasion resistant material. The outer layer 86 optionally is perforated (not shown), for example to accommodate and/or facilitate the temperature increase of the circuit protection layer 58 during an overcurrent fault, to accommodate the physical expansion of the circuit protection layer 58, and/or the like. The outer layer 86 may cover any amount, and have any location(s) along, each of the base layer 54 and the circuit protection layer 58 of the mating segment 48. In some embodiments, the circuit protection layer 58 covers more of the base layer 84 than the outer layer 86, the outer layer 86 covers more of the base layer 84 than the circuit protection layer 58, and/or the outer layer 86 does not cover the approximate entirety of the circuit protection layer 58. Any number of the power contacts 44 may include the circuit protection layer 58. Moreover, any number of the mating segments 48 of each power contact 44 may include the circuit protection layer 58.

As shown in FIG. 6, the circuit protection layer 58 extends on both sides of the mating segment 48 of two power contacts 44*a* of the power contacts 44*a* and on only one side of two other power contacts 44*b* of the power contacts 44. But, any number of the power contacts 44 may include the circuit protection layer 58 on both sides of the mating segment 48 thereof and any number of the power contacts 44 may include the circuit protection layer 58 on only one side of the mating segment 48 thereof. In some embodiments all of the power contacts 44 include the circuit protection layer 58 on both sides of the mating segment 48 thereof. In other embodiments, all of the power contacts 44 include the circuit protection layer 58 on only one side of the mating segment 48 thereof.

As can be seen from a comparison of FIGS. 1, 5, and 6, in the illustrated embodiment, the power contacts 32*a* (not shown in FIGS. 5 and 6) of the power connector 16 (not shown in FIGS. 5 and 6), which include the circuit protection layer 58, mate with corresponding power contacts 44 of the corresponding mating power connector 18 that also include the circuit protection layer 58. Moreover, in the illustrated embodiment, the power contacts 32*b* (not shown in FIGS. 5 and 6) of the power connector 16, which do not include the circuit protection layer 58, mate with corresponding power contacts 44 of the corresponding mating power connector 18 that do include the circuit protection layer 58. But, any number of the power contacts 32 that include the circuit protection layer 58 may mate with corresponding power contacts 44 that also include the circuit protection layer 58. Any number of the power contacts 32 that do not include the circuit protection layer 58 may mate with corresponding power contacts 44 that also do not include the circuit protection layer 58. Moreover, any number of the power contacts 32 that include the circuit protection layer 58 may mate with corresponding power contacts 44 that do not include the circuit protection layer 58, and vice versa. The number of power contacts 32 and the number of power contacts 44 that include the circuit protection layer 58 may be selected to provide a predetermined amount, type, configuration, and/or the like of overcurrent protection.

Figure 7:
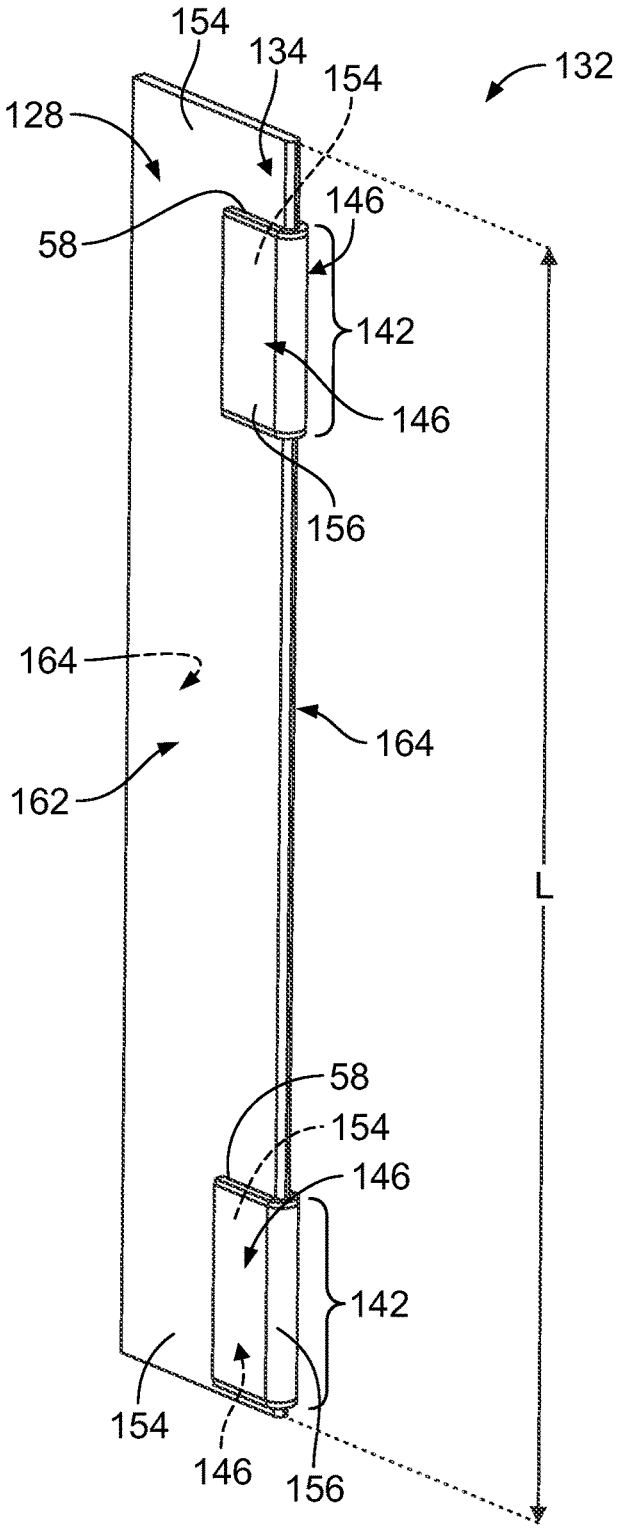
FIG. 7 is a perspective view of another embodiment of an electrical power contact.

FIG. 7 is a perspective view of another embodiment of an electrical power contact 132. The power contact 132 is defined by an edge portion 134 of a power bus bar assembly 128. Specifically, one or more mating segments 142 of the power contact 132 are defined by the edge portion 134 of the bus bar assembly 128. Each mating segment 142 includes a mating interface 146 at which the power contact 132 is configured to mate with another component, such as, but not limited to, directly to a power supply (not shown; e.g., the power supply 14 shown in FIG. 1), to a connector (not shown; e.g., the power connector 16 shown in FIGS. 1-4) of a power supply, to another power bus bar assembly (not shown; e.g., the bus bar assembly 28 shown in FIG. 1), and/or the like. In the illustrated embodiment, the bus bar assembly 128 includes only a single layer. But, the bus bar assembly 128 may include any number of layers. The bus bar assembly 128 may be referred to herein as a "power bus bar", regardless of the number of layers.

The mating segments 142 of the power contact 132 include circuit protection elements that are configured to protect against overcurrent faults. Specifically, the mating segments 142 include an electrically conductive base layer 154 and an electrically conductive outer layer 156 that extends over the base layer 154, with a circuit protection layer 58 extending between the base layer 154 and the outer layer 156. As shown in FIG. 7, the outer layer 156 defines an outer surface (of the corresponding mating segment 142) that includes the mating interface 146 of the mating segment 142.

As described above with respect to the power connector 16 and the power connector 18 (shown in FIGS. 1, 5, and 6), the circuit protection layer 58 includes a selectively conductive material and is configured to protect against overcurrent faults. Specifically, the circuit protection layer 58 is configured to open an electrical pathway between the base layer 154 and the outer layer 156 (provided by the circuit protection layer 58) when an electrical current above the predetermined threshold is passed through the circuit protection layer 58 (i.e., during an overcurrent fault). When the circuit protection layer 58 is in the on state, the power contact 132 can carry the hold current. When the circuit protection layer 58 is in the off state, the power contact 132 does not carry the hold current. The circuit protection layer 58 is thus a passive circuit protection element that provides overcurrent protection for the bus bar assembly 128.

Although two are shown, the edge portion 134 may define any number of mating segments 142. Each mating segment 142 may have any location along the length L of the edge portion 134 of the bus bar assembly 128. In some embodiments, the edge portion 134 defines a single mating segment 142, regardless of whether the signal mating segment 142 extends along an approximate entirety of a length L of the edge portion 134. Any number of the mating segments 142 may include the circuit protection layer 58. The circuit protection layer 58 of each mating segment 142 may cover any amount of the base layer 154 of the mating segment 142. In some embodiments, the edge portion 134 defines a single mating segment 142 that extends along an approximate entirety of the length L of the edge portion 134.

The outer layer 156 may be fabricated from any material(s) that provide the outer layer 156 as sufficiently electrically conductive to carry the hold current. In some embodiments, the outer layer 156 includes an abrasion resistant material. The outer layer 156 optionally is perforated (not shown), for example to accommodate and/or facilitate the temperature increase of the circuit protection layer 58 during an overcurrent fault, to accommodate the physical expansion of the circuit protection layer 58, and/or the like. The outer layer 156 may cover any amount, and have any location(s) along, each of the length L of the edge portion 134, the base layer 154 of a mating segment 142, and the circuit protection layer 58 of each mating segment 158. In some embodiments, the circuit protection layer 58 covers more of the base layer 154 than the outer layer 156 of one or more mating segments 142, the outer layer 156 covers more of the base layer 84 than the circuit protection layer 58 of one or more mating segments 142, and/or the outer layer 86 does not cover the approximate entirety of the circuit protection layer 58 of one or more mating segments 142.

As shown in FIG. 7, in the illustrated embodiment, the circuit protection layer 58 of each mating segment 142 extends on both sides 162 and 164 of the edge portion 134 of the bus bar assembly 128. But, the circuit protection layer 58 of any number of the mating segments 142 may extend on only the side 162 of the edge portion 134, the circuit protection layer 58 of any number of the mating segments 142 may extend on only the side 164 of the edge portion 134, and the circuit protection layer 58 of any number of the mating segments 142 may extend on both sides 162 and 164 of the edge portion 134.

The embodiments described and/or illustrated herein provide an electrical power contact that includes a circuit protection layer that provides protection against overcurrent faults. The embodiments described and/or illustrated herein provide an electrical component (e.g., a contact, a connector, and/or the like) with a passive circuit protection device that does not add an additional circuit to the electrical component and therefore may not increase the size of the electrical component and/or may increase the size of the electrical component less than at least some known active circuit protection devices.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical power contact comprising:

a mating segment configured to extend within a receptacle, the mating segment having a mating interface at which the electrical power contact is configured to mate with a mating contact within the receptacle, the mating segment comprising:

an electrically conductive base layer;

an electrically conductive outer layer comprising the mating interface; and a circuit protection layer extending between the base layer and the outer layer, the circuit protection layer providing an electrical pathway between the base layer and the outer layer, wherein the circuit protection layer comprises a selectively conductive material that is configured to open the electrical pathway between the base layer and the outer layer when an electrical current above a predetermined threshold is passed through the circuit protection layer.

2. The electrical power contact of claim 1, wherein the circuit protection layer is configured to open the electrical path between the base and outer layers during an overcurrent fault.

3. The electrical power contact of claim 1, wherein the selectively conductive material of the circuit protection layer is configured to open the electrical pathway between the base and the outer layers when heated to a predetermined temperature threshold.

4. The electrical power contact of claim 1, wherein the selectively conductive material of the circuit protection layer is configured to open the electrical pathway between the base and outer layers by physically expanding when heated by electrical current passing through the circuit protection layer.

5. The electrical power contact of claim 1, wherein the selectively conductive material of the circuit protection layer comprises a polymeric positive temperature coefficient (PPTC) material.

6. The electrical power contact of claim 1, wherein the selectively conductive material of the circuit protection layer comprises a thermally conductive plastic loaded with carbon particles.

7. The electrical power contact of claim 1, wherein the outer layer comprises an abrasion resistant material.

8. The electrical power contact of claim 1, wherein the mating segment is defined by an edge of a power bus bar.

9. The electrical power contact of claim 1, further comprising an electrical power connector having a housing, wherein the electrical power contact is held by the housing.

10. An electrical power contact comprising:

a mating segment configured to extend within a receptacle, the mating segment having a mating interface at which the electrical power contact is configured to mate with a mating contact within the receptacle, the mating segment comprising:

an electrically conductive base layer;

an electrically conductive outer layer comprising the mating interface; and a polymeric positive temperature coefficient (PPTC) layer extending between the base layer and the outer layer, the PPTC layer providing an electrical pathway between the base layer and the outer layer, wherein the PPTC layer is configured to open the electrical pathway between the base layer and the outer layer when an electrical current above a predetermined threshold is passed through the PPTC layer.

11. The electrical power contact of claim 10, wherein the PPTC layer is configured to open the electrical pathway between the base and outer layers by physically expanding when heated by electrical current passing through the PPTC layer.

12. The electrical power contact of claim 10, wherein the PPTC layer comprises a thermally conductive plastic loaded with carbon particles.

13. The electrical power contact of claim 10, wherein the outer layer comprises an abrasion resistant material.

14. The electrical power contact of claim 10, wherein the mating segment is defined by an edge of a power bus bar.

15. The electrical power contact of claim 10, further comprising an electrical power connector having a housing, wherein the electrical power contact is held by the housing.

16. An electrical power connector comprising:

an electrical power contact having a mating segment configured to extend within a receptacle of the electrical power connector, the mating segment having a mating interface at which the electrical power contact is configured to mate with a mating contact within the receptacle, the mating segment comprising:

an electrically conductive base layer;

an electrically conductive outer layer comprising the mating interface; and a circuit protection layer extending between the base layer and the outer layer, the circuit protection layer providing an electrical pathway between the base layer and the outer layer, wherein the circuit protection layer comprises a selectively conductive material that is configured to open the electrical pathway between the base layer and the outer layer when an electrical current above a predetermined threshold is passed through the circuit protection layer.

17. The electrical power connector of claim 16, wherein the selectively conductive material of the circuit protection layer comprises a polymeric positive temperature coefficient (PPTC) material.

18. The electrical power connector of claim 16, further comprising a power bus bar, wherein the power bus bar comprises an edge that defines the mating segment of the electrical power contact.

19. The electrical power connector of claim 16, further comprising a housing having a mating interface at which the housing is configured to mate with a mating connector that includes the mating contact, the electrical power contact being held by the housing, wherein the housing is mounted to a power bus bar, is mounted to a printed circuit board, or terminates an electrical cable.

20. The electrical power connector of claim 16, wherein the electrical power contact is a first electrical power contact, the electrical power connector further comprising a second electrical power contact that does not include a circuit protection layer.

* * * * *